US011454478B2

(12) United States Patent
Mack

(10) Patent No.: US 11,454,478 B2
(45) Date of Patent: Sep. 27, 2022

(54) PROJECTILE TARGET WITH HIT INDICATOR

(71) Applicant: HORNADY MANUFACTURING COMPANY, Grand Island, NE (US)

(72) Inventor: Matthew Mack, Grand Island, NE (US)

(73) Assignee: Hornady Manufacturing Company, Grand Island, NE (US)

( * ) Notice: Subject to any disclaimer, the term of this patent is extended or adjusted under 35 U.S.C. 154(b) by 0 days.

(21) Appl. No.: 16/911,164

(22) Filed: Jun. 24, 2020

(65) Prior Publication Data

US 2020/0400409 A1 Dec. 24, 2020

Related U.S. Application Data

(60) Provisional application No. 62/865,662, filed on Jun. 24, 2019.

(51) Int. Cl.
*F41J 5/056* (2006.01)
*F41J 5/14* (2006.01)
*F41J 5/02* (2006.01)

(52) U.S. Cl.
CPC ..... *F41J 5/056* (2013.01); *F41J 5/02* (2013.01); *F41J 5/14* (2013.01)

(58) Field of Classification Search
CPC ..... F41J 5/056; F41J 5/14; F41J 5/02
USPC ..... 273/371
See application file for complete search history.

(56) References Cited

U.S. PATENT DOCUMENTS 2,751,581 A * 6/1956 Waltman ..... G08G 1/0955 362/112
3,966,160 A * 6/1976 Wilson ..... A61M 5/1417 248/311.3
4,349,728 A * 9/1982 Phillips ..... G01S 5/22 434/1
5,092,607 A * 3/1992 Ramsay ..... F41J 5/056 273/372
5,676,548 A * 10/1997 McAlpin ..... F41J 5/056 434/11
2003/0131518 A1* 7/2003 Komberger ..... F41G 11/007 42/135
2008/0002395 A1* 1/2008 Eisenberg ..... F41H 13/0087 362/296.07
2014/0042700 A1* 2/2014 Baron ..... F41J 1/00 273/408
2014/0151965 A1* 6/2014 Garas ..... F41J 5/06 273/371

(Continued)

*Primary Examiner* — Robert P Bullington, Esq.
*Assistant Examiner* — Stephen Alvesteffer
(74) *Attorney, Agent, or Firm* — McHale & Slavin, P.A.

(57) ABSTRACT

The present invention provides an improved target system for use by target shooters. The target system includes any target that is solid enough to transfer a portion of the impact to the frame supporting the target. An impact sensor that is independent from the target is attached to the frame supporting the target. When the target is hit by a bullet, the impact causes the impact sensor to light an indicator light to indicate that the target was hit. In some embodiments, the indicator light is housed in a housing that includes an adjustable lens to focus the light and concentrate its direction toward the shooter. In other embodiments, a remote indicator light is utilized and the impact sensor sends a radio signal to the indicator light to cause it light up when the target is impacted.

23 Claims, 8 Drawing Sheets

(56) References Cited

U.S. PATENT DOCUMENTS

| | | | | |
|---|---|---|---|---|
| 2018/0202774 | A1* | 7/2018 | Sitzman | F41J 5/06 |
| 2019/0041172 | A1* | 2/2019 | Kerley | F41J 5/06 |

* cited by examiner

PROJECTILE TARGET WITH HIT INDICATOR

RELATED APPLICATIONS

In accordance with 37 C.F.R. 1.76, a claim of priority is included in an Application Data Sheet filed concurrently herewith. Accordingly, the present invention claims priority to U.S. Provisional Patent Application No. 62/865,662, entitled "PROJECTILE TARGET WITH HIT INDICATOR", filed Jun. 24, 2019. The contents of the above referenced application are incorporated herein by reference in its entirety.

FIELD OF THE INVENTION

The present invention relates to a target for use with a firearm, or the like, with a visible indication that the target has been struck by a projectile such as a bullet.

BACKGROUND OF THE INVENTION

Target shooting is a commonly practiced sport throughout the world. Target shooting can involve one or more of many different types of targets and styles of shooting. It can range from simply shooting a metal can to shooting through a "screen" and having acoustic sensors send data back to a display screen to show where in the screen the bullet passed through. A typically practiced form of target shooting includes placing a paper target at a distance with an aiming point printed on the paper, for example a circle, and using the firearm sites to direct a projectile from a firearm at the aiming point. Usually a group of projectiles are shot through the target and the group size is measured for both size and location relative to the aiming point. After the shooter has completed shooting the target, the shooter retrieves the target by walking to and from the target stand. The group can then be evaluated. Often times, the target is at such a remote distance, for example 1,000 yards or more, that the group cannot be evaluated without retrieving the target or having a very high-powered spotting scope available to view the group during shooting. Such target shooting is generally used for measurement of firearm precision and/or accuracy.

Another form of target shooting involves the use of a target that converts kinetic energy of the bullet striking the target into a visible indicator that the target has been hit. Such a target often involves the use of a metal plate mounted to a stand that, when hit by a bullet, will move and emit an audible sound to indicate the target has been hit. This type of target, however, cannot be evaluated for group size other than by its size, for example, a three inch diameter target versus an eight inch diameter target. Such a target does not necessitate retrieval of the target to determine whether the target has been hit. However, this type of target may be difficult to determine if it has been hit, particularly when it is at a long-range, for example, 300 yards or more. Such long-range shooting will typically involve a scoped rifle, which can be easily used to see the target. But, time is required to reposition the scope to view the target after it has been hit; and by that time, visible movement of the target may have ceased. Such target shooting is generally used for measurement of firearm accuracy.

Both of the above described methods of target shooting are well known in the art. There have been attempts to improve the convenience of both types of target shooting. There are devices available on the market that have the bullet pass through a "screen" with sensors, for example acoustic sensors, to indicate and provide information to the shooter where the bullet passes through the screen. Additionally, U.S. Patent Application Publication Nos. 2018/0202774 and 2019/0041172 disclose types of targets that visually indicate that a target has been struck by the bullet. Both require a metal target with a bullet hit sensor being secured to the metal target that senses the hit and provides a light directed at the shooter to indicate that the target has been hit. These two applications disclose targets that are expensive and complex, and are subject to failure with repeated shooting. There is also the risk of damage to the sensor units since they are mounted to metal targets and absorb some of the kinetic energy from the striking bullet.

There is thus a need for an improved target that provides a positive indication that it has been struck by a bullet, even at long ranges.

DESCRIPTION OF THE PRIOR ART

U.S. Patent Application Nos. 2018/0202774 and 2019/0041172 disclose two forms of firearm targets that will present a light to the shooter to indicate when the target has been struck by a bullet. Both utilize a metal plate suspended from the stand. Each of them utilizes a sensor unit that is mounted on the off side of the metal plates to sense when the plate has been struck by a bullet and activate a light directed at the shooter.

SUMMARY OF THE INVENTION

The present invention provides an improved target system for use by target shooters. The target system includes any target that is solid enough to transfer a portion of the impact to the frame supporting the target. An impact sensor that is independent from the target is attached to the frame supporting the target. When the target is hit by a bullet, the impact causes the impact sensor to light an indicator light to indicate that the target was hit. In some embodiments, the indicator light is housed in a housing that includes an adjustable lens to focus the light and concentrate its direction toward the shooter. In other embodiments, a remote indicator light is utilized and the impact sensor sends a radio signal to the indicator light to cause the indicator light to light up when the target is impacted.

An objective of the present invention is to provide an inexpensive but effective target system that is operable to visually indicate from a distance when it is struck by a bullet.

Accordingly, it is a primary objective of the present invention to provide a target system that initiates a hit indicator light by sensing vibration of the target.

It is a further objective of the present invention to provide such a target system with a target made of a nonmetallic bullet contacting material.

It is yet another objective of the present invention wherein the hit indicating light is configured to transmit light through the target.

It is a still further objective of the invention to provide a hit indicating light and hit sensing unit that can be mounted on different targets.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
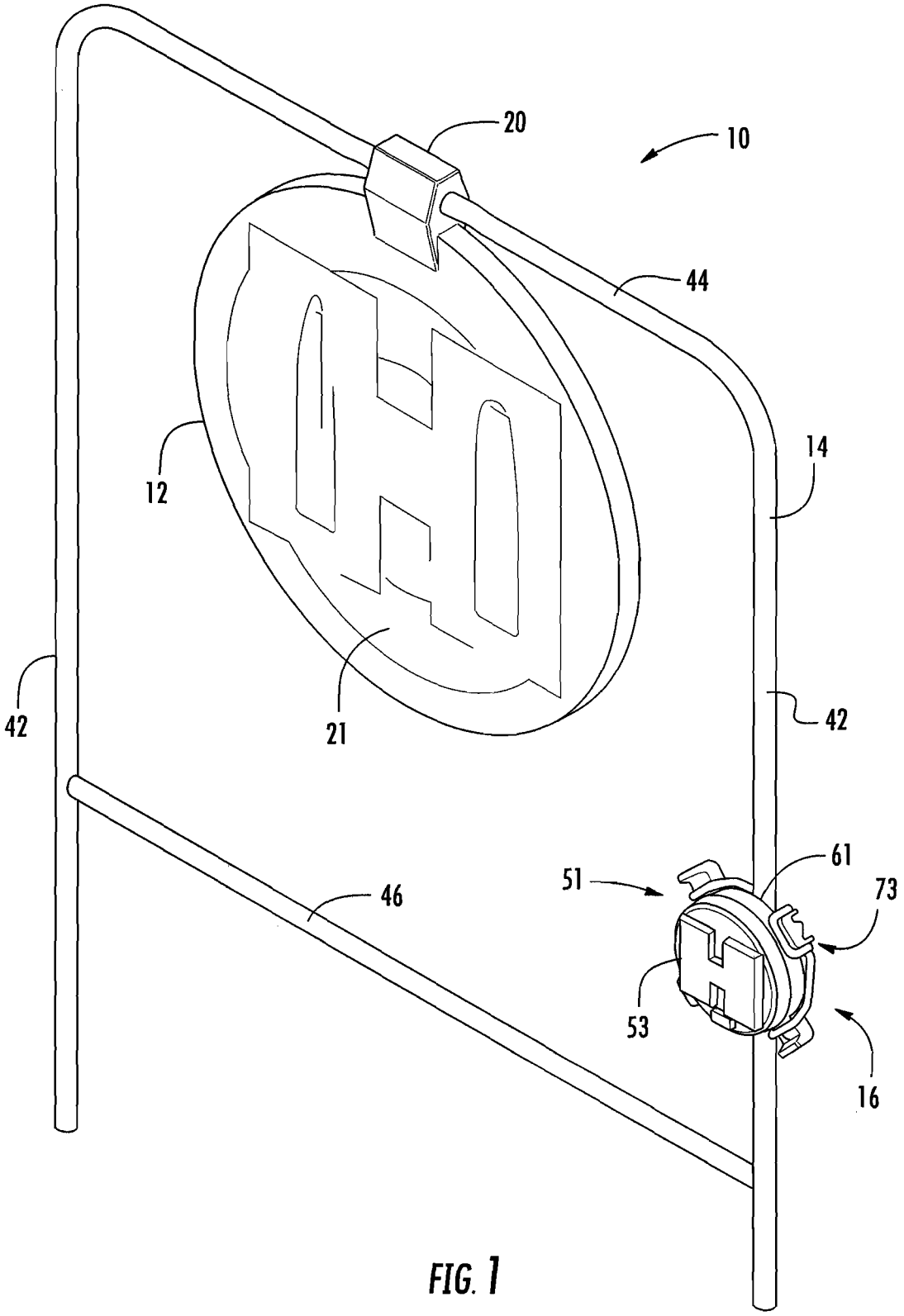
FIG. 1 is an isometric view of a target in combination with a target stand and hit indicating unit.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Referring to FIGS. 1-10, a target system 10 comprising a target 12 mounted on a stand 14 and a target hit indicator system 16 that is operable to provide at least a visual indication of when the target 12 is impacted by a projectile is illustrated. As used herein, a projectile includes, but should not be limited to, a bullet, BB, pellet, airsoft projectile, foam-based projectile like those sold under the NERF trademark (NERF is a subsidiary of Hasbro, Inc., Pawtucket, R.I.), and the like. The target system 10 is adapted for use to indicate the impact of a projectile, such as a bullet, from a firearm, such as a rifle or pistol, which shoots a single projectile at a time. A typical firearm can be adapted to fire a rimfire or centerfire cartridge, as are known in the art, a BB gun, and a pellet gun. A sling shot could also be used to discharge a projectile.

The target 12 is suitably mounted to the stand 14 in one embodiment to allow for its movement when impacted by a bullet to help dissipate bullet kinetic energy, or, in another embodiment, be fixed against movement relative to the stand. As shown, the target 12 is mounted on the stand 14 by a coupler 20 that is preferably pivotally mounted on a portion of the stand 14 as described below. The target 12 can be any suitable size and shape on the surface 21 facing the shooter (the on or shooter side), and can be made of any suitable material as described below. While a stand designed to be fixed in place, at least temporarily, is illustrated, it is to be understood that the target 12 can be moving during use; for example, swinging side to side or moving along a track side to side. For long range shooting or shooting with a pistol at close range, the target can be larger than those that can be used for shorter range rifle shooting if desired. The target 12 can be in the shape of a silhouette, generally rectangular, generally round or any other desirable shape. A generally round shape is common for target shooting and is shown in the illustrated Figures. Typically, a target 12 is a monolithic structure and made out of a metallic material, such as steel, and has a thickness and weight appropriate for the anticipated bullet energy that is being shot at the target. A rimfire target will have a thickness on the order of ⅛ to ¼ inch, while high-powered centerfire rifle targets may have a thickness of ⅜ inch or thicker. Current targets that are designed to indicate a hit by movement have their mass selected to provide the desired amount of movement and resistance to damage. The target 12 in the illustrated structure can be made of any suitable material, such as a metallic material as described above or what is commonly referred to as a self-healing material, which can be a polymer or synthetic material, such as an elastomer or plastic. They can also be reinforced with a fibrous material such as fiberglass or the like. In the case of a polymeric material, the target 12 may have a thickness that will allow the bullet to pass therethrough, rather than not passing through as with a metallic target. In one embodiment, the polymeric material can be translucent or have a translucent portion to allow light to be transmitted therethrough. Suitable polymeric materials can include thermoplastic, elastomers, and urethane.

Figure 2:
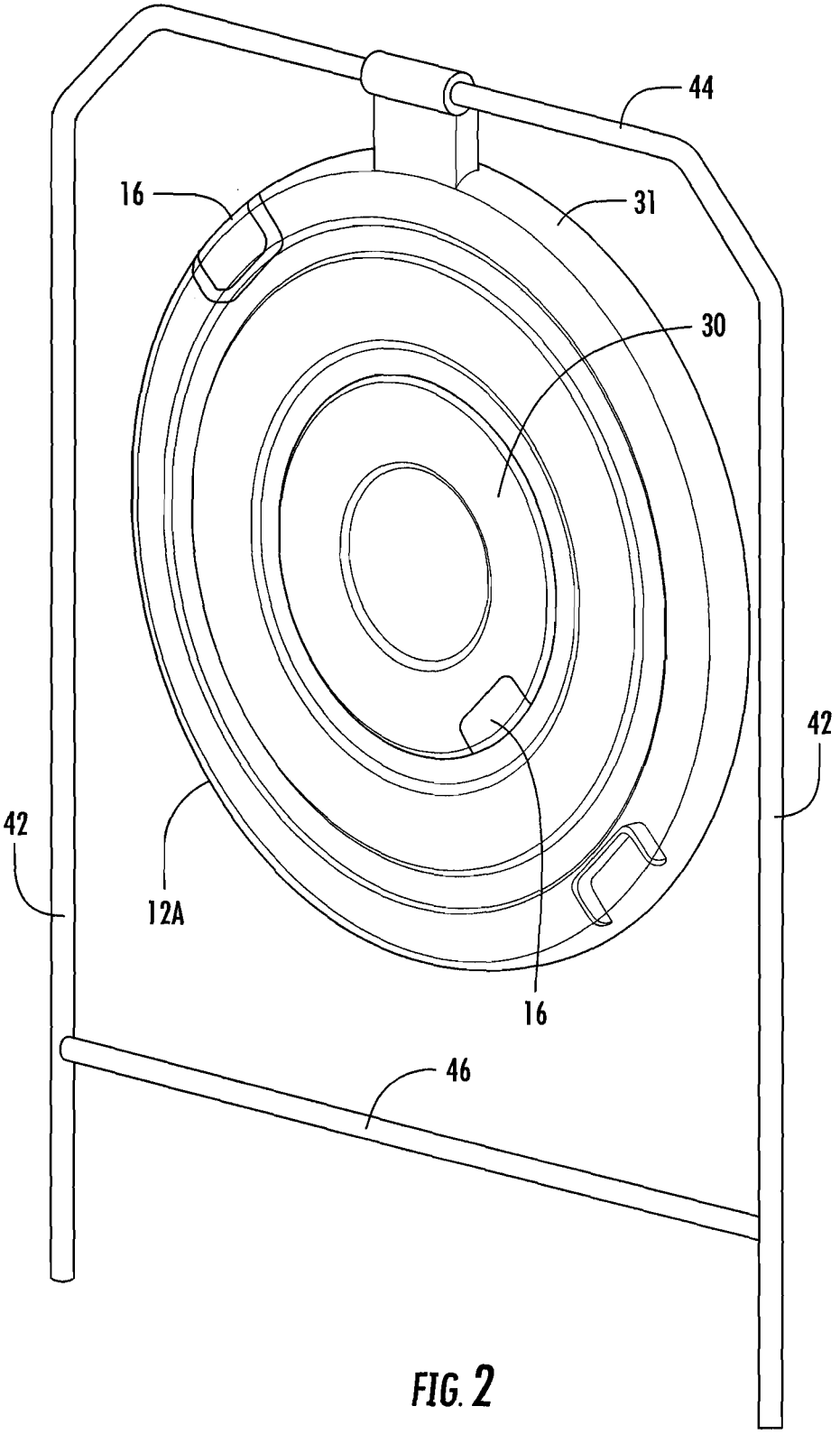
FIG. 2 is an isometric view of a second embodiment of a target system.

In one embodiment, the target 12 can be segmented into at least two segments. As best seen in FIG. 2, the central portion of the target 12A can be a first segment 30, and an outer ring surrounding the first segment 30 can be a second segment 31, providing the plurality of segments. As another example, the target 12 can be segmented into a plurality of pie shaped sections extending outwardly from the center of the target 12. The purpose for the segments is described below. The segments 30, 31 can have different properties, such as hardness, thickness and the like to vibrate differently when impacted by a bullet.

The stand 14 may be any suitable stand on which the target 12 can be mounted. As shown, the stand 14 may be transportable, and may be a generally U-shaped stand configured for a shooter to insert the bottom portions of the generally parallel legs 42 into the ground for removably erecting the stand 14 in a generally vertical orientation. While a U-shaped stand 14 is shown, it is to be understood that the stand can be of any suitable shape and construction. In the illustrated stand 14, the legs 42 are connected by a bight 44 on which the coupler 20 is pivotally mounted to preferably allow for swinging movement of the target 12 when impacted by a bullet or other projectile. The coupler 20 can be a portion of the target 12, or can be a separate component secured to the target 12 as with suitable fasteners, adhesive or the like. Preferably, the coupler 20 is of a configuration that allows replacement of the target 12 on the stand 14 in an easy manner. The stand 14 can be made out of any suitable material, such as metal (for example steel), polymeric material or wood. It is to be noted that the stand 14, when portable, can also be provided with a foot engageable projection 46 attached to one or more of the legs 42 to assist in inserting the lower portions of the legs 42 into the ground. In the illustrated structure, the projection 46 is a bar that is secured at each of its opposite ends to a respective leg 42.

Figure 3:
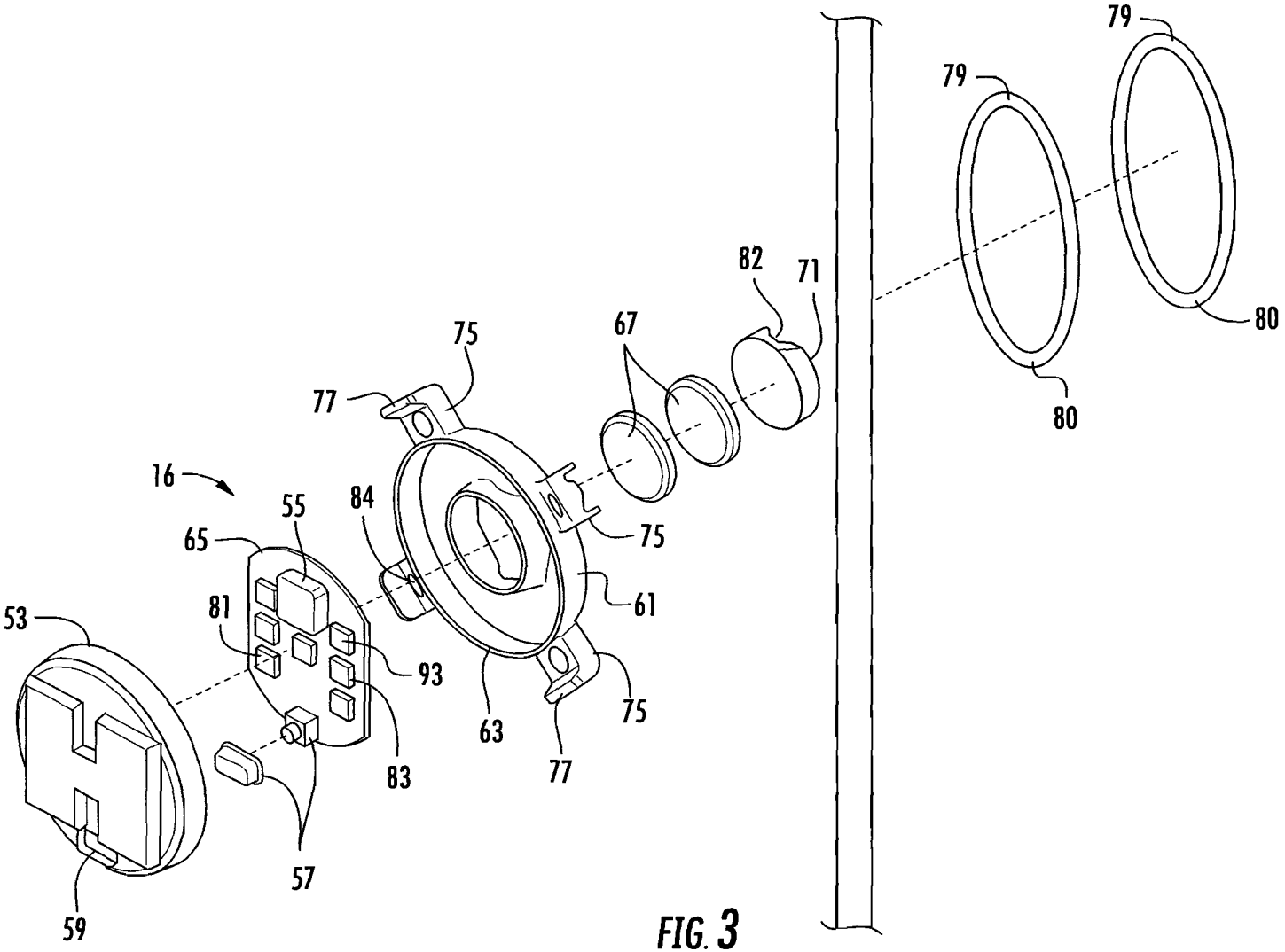
FIG. 3 is an enlarged exploded isometric view of the hit indicating unit of FIG. 1.
Figure 4:
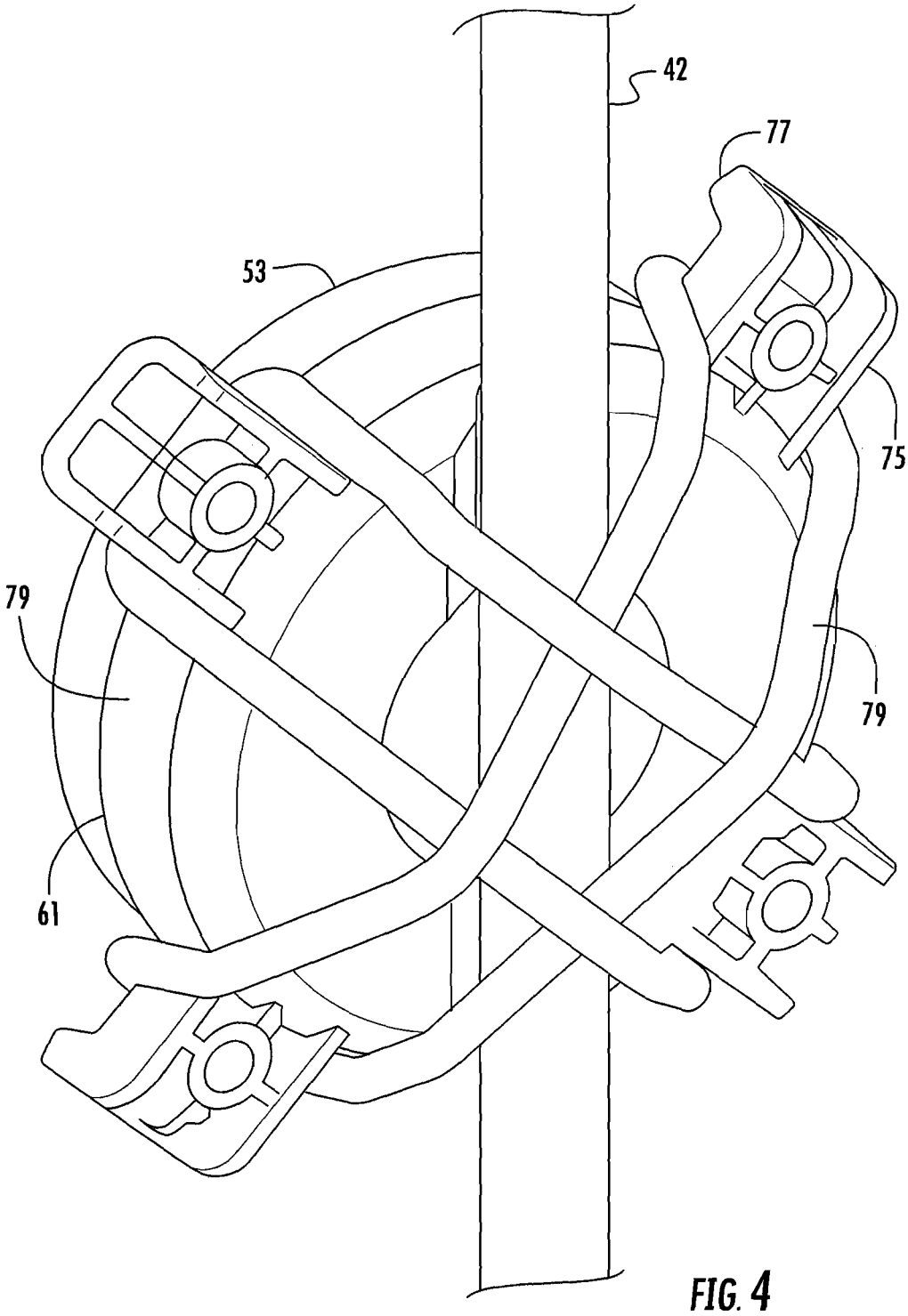
FIG. 4 is an enlarged isometric view of the hit indicating unit as seen in FIG. 1.
Figure 5:
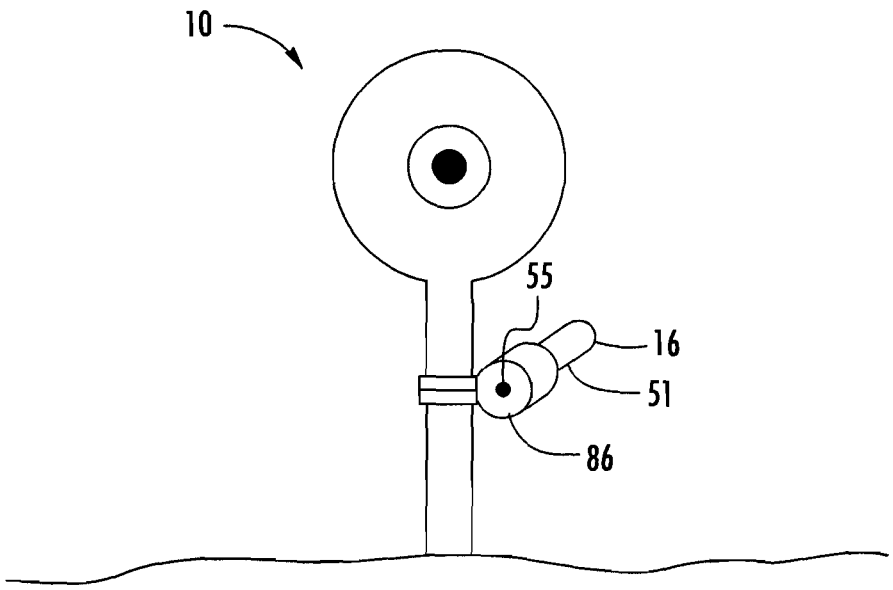
FIG. 5 is an isometric view of an embodiment including a parabolic reflector and lens for the hit indicator light for long range focusing of the light beam.
Figure 6:
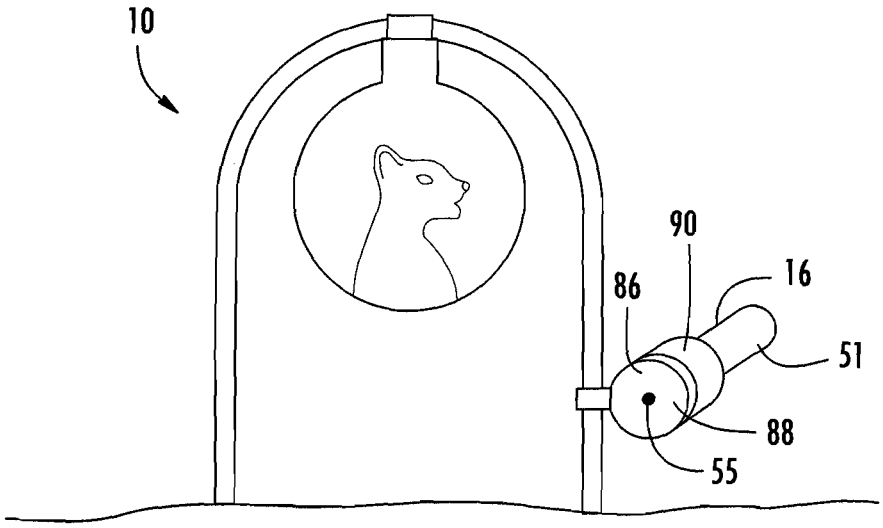
FIG. 6 is an isometric view of the embodiment illustrated in FIG. 5 attached to a different type of target mount.

The bullet hit indicator system 16 is best seen in FIGS. 3, 4. In one embodiment, FIG. 1, the hit indicator system 16 is mounted on the stand 14. In an alternate embodiment, the hit indicator system 16 can be incorporated into the target 12 if desired, FIG. 2. The function of either embodiment is the same as described below. The hit indicator system 16 will be described as the embodiment shown in FIG. 3. However, regardless of mounting position and configuration, they function the same. The hit indicator system 16 includes a housing 51 (FIG. 1) that is adapted to be mounted on the stand 14. It can be mounted on either the bight 44 or a leg 42. As shown, it is mounted on a leg 42. The housing 51 includes a cover 53 that is preferably configured for facing toward the shooter. In a preferred embodiment, the cover 53 is translucent for allowing light to be transmitted therethrough from a light source 55, such as an LED. As shown, the cover 53 is provided with an on/off switch button 57. In the illustrated non-limiting structure, the switch button 57 extends through an opening 59 in the cover 53. The housing 51 includes a base portion 61 that is adapted to have the cover 53 mounted thereto. Preferably, the housing 51 provides a weather resistant enclosure. The base 61 and cover 53 form a storage chamber 63 adapted to hold an electronic component(s) 65 therein. The housing 51 is also configured for the retention of one or more electrical energy sources, such as batteries 67, therein to provide energy to the electronic component 65. The battery(ies) 67 can be removably held in place in the housing 51 by a removable cap 71 that is removably mounted to the base 61.

An attachment system is provided for mounting the hit indicator system 16 on a portion of the target system 10 in a manner to receive vibrations or the like therefrom upon bullet impact to the target 12. As shown, the base 61 is provided with an attachment system, designated generally 73, which is configured to removably mount the hit indicator system 16 in a position adjacent to the target 12. As shown, one embodiment of the attachment system 73 includes two or more arms 75. The illustrated structure includes four arms projecting radially outwardly from the base 61. Preferably, each of the arms 75 have a forwardly facing foot 77 adapted for releasably retaining a securement device 79 on the arms 75. In the illustrated structure, a pair of securement devices 79 is used, and is in the form of elastic bands, such as stretchable O-rings 80, forming a crisscross pattern at the back of the base 61, FIG. 4. Such an arrangement for securement provides the ability to attach the hit indicator system 16 to a stand 14 that can be transported between ranges or to an existing stand 14 at a shooting range, or an existing permanent stand. The base 61 can also be provided with a rearwardly opening channel 82 to help hold the hit indicator system 16 in a given orientation by receiving therein a portion of the stand 14. Each of the arms 75 can also be provided with a through-hole 84 for the use of screw fasteners to attach the hit indicator system 16 to a stand 14, such as an existing permanent stand. The latter form of securement is particularly well adapted for mounting the hit indicator system 16 on a wooden stand.

The electronic component 65 is operable to sense a bullet hitting the target 12 and activate at least one light 55 to provide a visual indication of a bullet hit on the target 12. When a bullet strikes a target, vibration is generated. Vibration in the target 12 that is transmitted to the stand 14 is a mechanical phenomenon of oscillations about an equilibrium point in an object. The mechanical vibrations can be converted to sound, which are vibrating pressure waves transmitted through a medium such as air. The electronic component 65 is provided to sense, directly or indirectly, the bullet hit generated vibration imparted to the target 12. An accelerometer 81 can be provided as part of the electronic component 65 to sense the mechanical vibrations imparted to the target 12 by a bullet hit, which, in turn, will activate the light 55. The electronic component 65 is provided with circuitry that will activate the light 55 in a predetermined manner; for example, to provide a hit signal for a predetermined amount of on time or a flashing light for a predetermined number of flashes to indicate visually to the shooter that the target 12 was hit. Vibration sensors are known in the art and include, but should not be limited to, piezo sensors, transducer sensors, eddy current or capacitive displacement sensors, pendulum switches, mercury switches and optical vibration sensors. If a segmented target 12A is utilized, as described above, the electronic component 65 can be provided with a plurality of different light signals, each one indicating the particular portion of the target that was hit. Additionally, as seen in FIG. 2, a plurality of indicator systems 16 can be provided in one target system 10. For example, a center hit can be indicated by a red light from one indicator system 16, while a peripheral hit can be indicated by a green light from another indicator system 16. In another embodiment, the electronic component 65 can be provided with a sound sensor 83 to work in combination with the accelerometer 81, or independent of the accelerometer 81 to activate the electronic component 65 to indicate a target hit with the at least one light 55. Such a sound sensor 83 can be a microphone or other sound sensing element. The electronic component 65 can be programmed to sense different sounds or different vibrations from different parts of the target and activate a desired light or signal type, constant on or flashing, as examples, to indicate which segment has been hit on a segmented target 12A using a single indicator system 16.

In another embodiment, the indicator system 16 can be incorporated into the target 12 to sense the mechanical vibration and/or sound generated by the mechanical vibration; see FIG. 2.

FIGS. 5-10 illustrate long range embodiments of the target system 10. In these embodiments the hit indicator system 16 is constructed and arranged to transfer the indicator light 55 over a longer distance, where a typical illumination of an LED, for example, may not be clearly visible to the shooter. These embodiments typically include a parabolic reflector 86 fixed or adjustably positioned with respect to the light source 55 to concentrate and direct the light produced by the light source through a focus lens 88 to control the diameter and range of visibility of the light source 55. In some embodiments, the hit indicator system 16 may resemble a traditional flashlight having the batteries positioned along a longitudinal axis of the housing 51; the power from the batteries also being supplied to an impact sensor, accelerometer or vibration sensor to cause the light 55 to illuminate upon detection of a predetermined threshold to indicate a hit on the target. In some embodiments, the parabolic reflector 86 and the focus lens 88 are secured to a bezel 90 that allows the parabolic reflector 86 to be positioned along the longitudinal axis of the housing 51 in a manner that alters the focal point 92 of the light source 55 to be altered. In this manner, a user can adjust the light beam for better viewing with respect to the distance the target system 10 is being used at. In at least one embodiment, the hit indicator system 16 is provided with a transmitter 93 and transmitter antenna 94. The transmitter 93 is constructed and arranged to communicate with a receiver station 96 having a receiver antenna 98 for receiving signals representing a hit on the target system 10, causing a light source 55 to illuminate at a remote location from the transmitter 93. In this embodiment, the impacts are monitored and a signal is sent to the receiver station 96 in response to hits on the target 12 in addition to or in place of lighting a light source directly on the hit indicator system housing 51. In this manner, target shots can be monitored with the local receiver station 96 in areas or over distances where a light on the housing 51 may not be visible. The receiver station 96 thus includes a light and/or audible response with respect to receiving a hit signal from the hit indicator system 16.

Figure 7A:
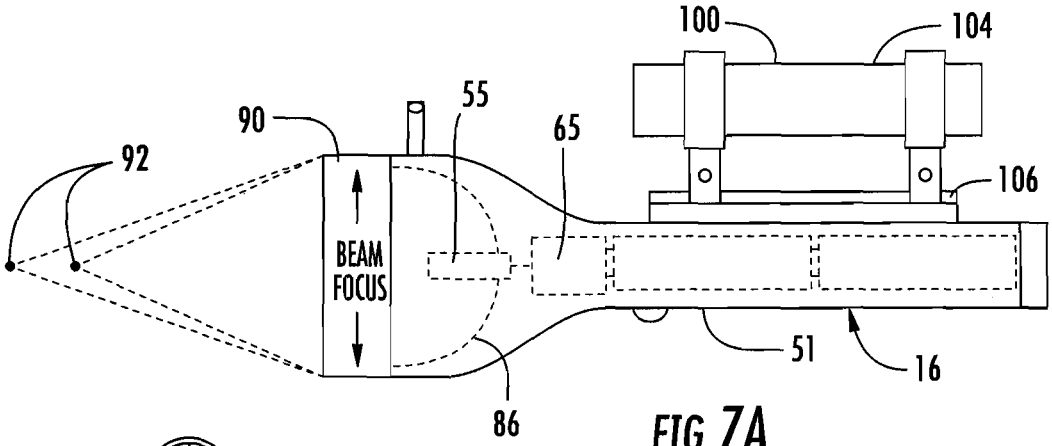
FIG. 7A is a side view of a hit indicator including a magnified sight for aiming the hit indicator light beam.
Figure 7B:
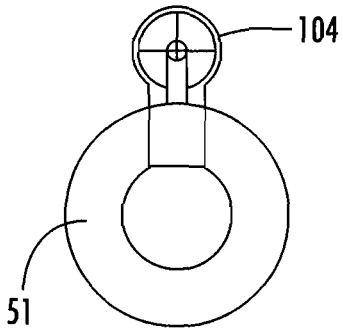
FIG. 7B is a rear view of the embodiment illustrated in FIG. 7A.
Figure 8A:
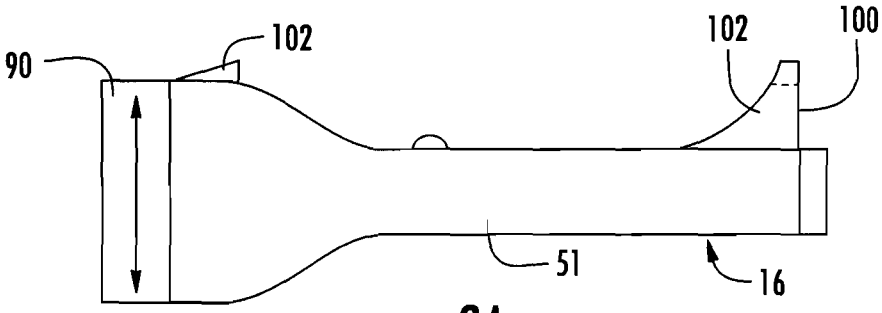
FIG. 8A is a side view of a hit indicator having mechanical sights for aiming the hit indicator light beam.
Figure 8B:
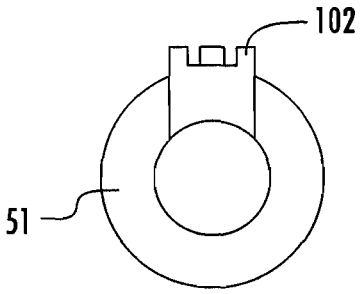
FIG. 8B is a rear view of the embodiment illustrated in FIG. 8A.

Referring generally to the FIGS., and more specifically to FIGS. 7A-7B, 8A-8B, an embodiment of the hit indicator system 16 wherein the housing 51 includes a sight 100 for aiming the light projected from the hit indicator system 16 toward the shooter. FIGS. 8A and 8B illustrate iron or open sights 102, while FIGS. 7A and 7B illustrate telescopic or peep sights 104. It should be noted that, while not illustrated, reflex sights such as are commonly referred to as "red dot" sights or laser sights may be utilized without departing from the scope of the invention. In at least some embodiments, a rail 106 is provided on the housing 51 that allows the sights 100 to be attached to the housing 51 as desired by the user.

Figure 9A:
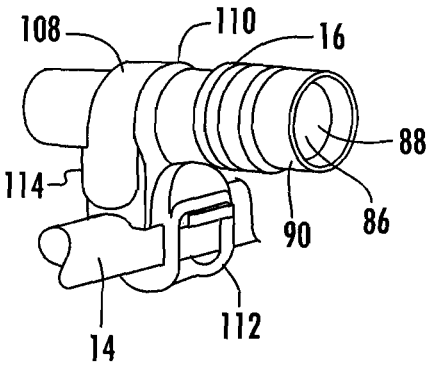
FIG. 9A is an isometric view of one embodiment of a hit indicator mount for securing a hit indicator to a target or target mount.
Figure 9B:
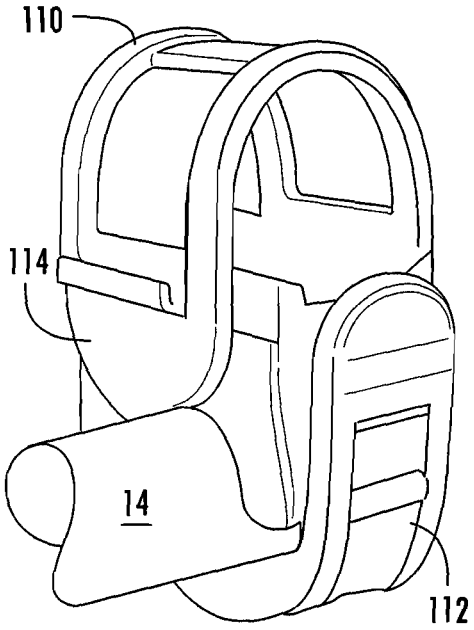
FIG. 9B is an isometric view of the hit indicator mount of FIG. 9A illustrated without the hit indicator.
Figure 9C:
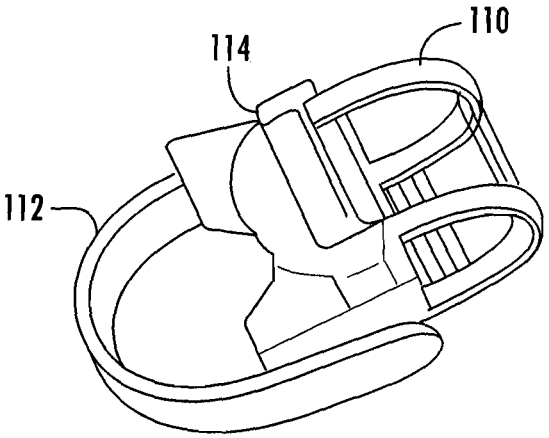
FIG. 9C is an isometric view of the hit indicator mount of FIG. 9A.
Figure 9D:
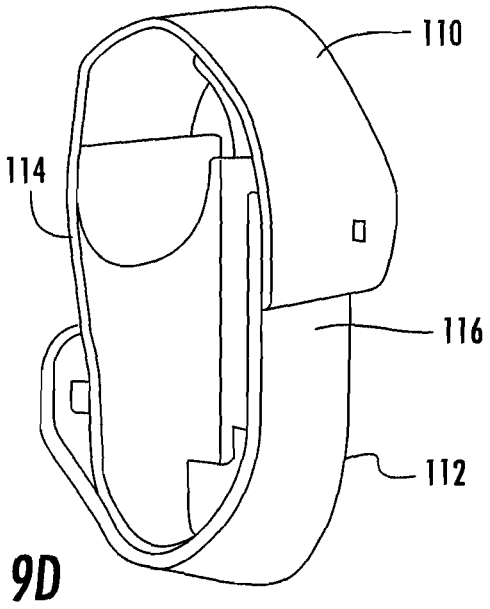
FIG. 9D is an isometric view of yet another hit indicator mount.
Figure 10:
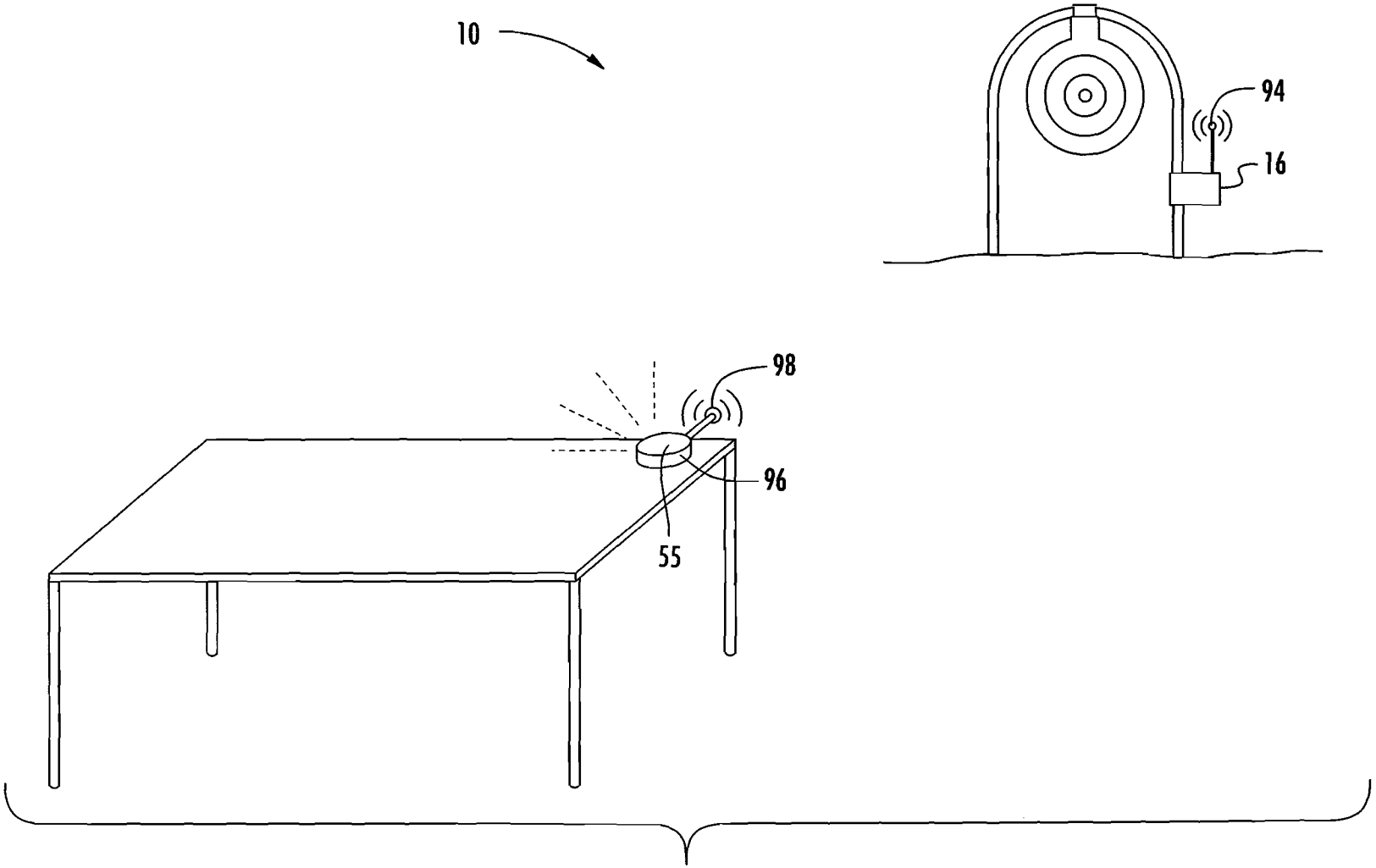
FIG. 10 is an isometric view illustrating a remote hit indicator light having an impact detector secured to the target mount.

Referring generally to the FIGS., and more specifically to FIGS. 9A-9D, a mount system 108 suitable for use in securing the hit indicator system 16 to the target 12 or target stand 14 is illustrated. The mount system 108 preferably includes a first loop 110 sized for encircling the hit indicator system 16 and a second loop 112 for encircling a portion of the target 12 or target stand 14. The first loop 110 and the second loop 112 are preferably arranged at right angles with respect to each other; however, it should be noted that a swivel 116 may be included between the two loops to allow the user to adjust the angle in which the hit indicator system 16 is arranged with respect to the target 12. It should also be appreciated that the loops are constructed from a stretchable polymeric material, whereby the loop is automatically adjustable to different sized targets and target stands. FIG. 9D illustrates another embodiment wherein the loops 110, 112 may be constructed from hook and loop material to facilitate any adjustment needed for attachment of the hit indicator system 16 to a target 12 or target stand 14. In either embodiment, a saddle 114 may be provided with a contour that provides good grip and positional orientation for the hit indicator system 16.

All patents and publications mentioned in this specification are indicative of the levels of those skilled in the art to which the invention pertains.

It is to be understood that while certain forms of the invention are illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A target system for projectiles comprising:

a target hit indicator, said target hit indicator including at least one visual indicator for indicating that a target in which said target hit indicator is attached was impacted by a projectile, said target hit indicator including a housing, said housing including an attachment system suitable for use in securing said hit indicator system to said target, said attachment system includes two or more arms projecting radially outwardly from said housing, each said arm including a forwardly facing foot adapted for releasably retaining an elastic member extending from one of two or more arms to the other of said two or more arms, a portion of said target positioned between said two or more arms and said elastic member, said housing including a light source secured therein, an electronic component secured within said housing and electrically connected to said light source, said electronic component being constructed and arranged to detect the impact of said projectile against said target, said electronic component is constructed and arranged to detect mechanical vibration of said target from said projectile impact against said target without direct attachment to said target to cause said light source to illuminate, a translucent cover for covering said light source, said translucent cover allowing light to be transmitted therethrough, one or more energy sources in electrical connection with said electronic component, said electronic component being constructed and arranged to transfer electrical energy to said light source upon detection of an impact exceeding a predetermined threshold to said target, said electronic component ceasing said transfer of electrical energy after a predetermined period of time, said electronic component automatically resetting to detect additional impacts after said predetermined period of time.

2. The target system for projectiles of claim 1 wherein said electronic component includes two or more predetermined thresholds for sensing impacts to said target; each said threshold causing said light source to illuminate in a different visible manner.

3. The target system for projectiles of claim 1 wherein said one or more energy sources are contained within said housing.

4. The target system for projectiles of claim 3 wherein said energy sources are batteries.

5. The target system for projectiles of claim 1 wherein said housing includes a parabolic reflector positioned with respect to said light source to create focal point of said light source.

6. The target system for projectiles of claim 5 wherein said parabolic reflector is adjustable along the longitudinal axis of said target hit indicator.

7. The target system for projectiles of claim 1 wherein said translucent cover includes a lens portion, said lens portion constructed and arranged to modify a light beam produced by said light source upon illumination.

8. The target system for projectiles of claim 1 wherein said housing includes at least one sight for aiming the trajectory of a light beam produced by said light source.

9. The target system for projectiles of claim 8 wherein said at least one sight is a set of open sights.

10. The target system for projectiles of claim 8 wherein said at least one sight is a set of peep sights.

11. The target system for projectiles of claim 8 wherein said at least one sight is a telescopic sight.

12. The target system for projectiles of claim 8 wherein said housing includes at least one rail constructed and arranged for attachment of said at least one sight.

13. The target system for projectiles of claim 8 wherein said housing is adapted to be secured to said target or target stand.

14. The target system for projectiles of claim 1 wherein said electronic component includes a transmitter for transmitting signals to a remote receiver, said remote receiver including at least one said light source for providing a visual indicator of target impact with said projectile.

15. The target system for projectiles of claim 1 wherein said projectile is a bullet.

16. The target system for projectiles of claim 1 including said target, said target secured to a stand to retain said target in a position suitable for visibility, said target remaining secured to said stand after impact by said projectile.

17. The target system for projectiles of claim 16 wherein said target is secured to said stand to allow for movement of said target when impacted by said projectile to dissipate kinetic energy from said projectile.

18. The target system for projectiles of claim 16 wherein said target is constructed from metal.

19. The target system for projectiles of claim 16 wherein said target is constructed from polymer, said polymer being a self-healing polymer whereby an aperture opened through said target by said projectile automatically closes after passage of said projectile through said target.

20. The target system for projectiles of claim 1 wherein said attachment system includes a first loop sized for encircling a portion of said hit indicator system and a second loop for encircling a portion of said target, said first loop and said second loop arranged at right angles with respect to each other.

21. The target system for projectiles of claim 20 wherein said first loop and said second loop are constructed from a stretchable polymeric material.

22. A target system for projectiles comprising:

a target hit indicator, said target hit indicator including at least one visual indicator for indicating that a target in which said target hit indicator is attached was impacted by a projectile, said target hit indicator including a housing, said housing including a light source secured therein, an electronic component secured within said housing and electrically connected to said light source, said electronic component being constructed and arranged to detect the impact of said projectile against said target, a translucent cover for covering said light source, said translucent cover allowing light to be transmitted therethrough, one or more energy sources in electrical connection with said electronic component, said electronic component being constructed and arranged to transfer electrical energy to said light source upon detection of an impact exceeding a predetermined threshold to said target, said electronic component ceasing said transfer of electrical energy after a predetermined period of time, said electronic component automatically resetting to detect additional impacts after said predetermined period of time, said target secured to a stand with a mount system to retain said target in a position suitable for visibility, said target remaining secured to said stand after impact by said projectile, said housing including an attachment system suitable for use in securing said hit indicator system to said target, said attachment system including a first loop sized for encircling a portion of said hit indicator system and a second loop for encircling a portion of said target, said first loop and said second loop arranged at right angles with respect to each other.

23. The target system for projectiles of claim 22 including a swivel securing said first loop and said second loop together for angular adjustment between said first loop and said second loop.

* * * * *